US011608711B2

(12) United States Patent
Baklanov et al.

(10) Patent No.: US 11,608,711 B2
(45) Date of Patent: Mar. 21, 2023

(54) SYSTEM AND METHOD FOR WIRELINE SHIFTING

(71) Applicant: Schlumberger Technology Corporation, Sugar Land, TX (US)

(72) Inventors: Nikolay Baklanov, Sugar Land, TX (US); Brandon Christa, Richmond, TX (US); Xuedong Yang, Sugar Land, TX (US); Thomas Mauchien, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/126,071

(22) Filed: Dec. 18, 2020

(65) Prior Publication Data

US 2021/0189820 A1 Jun. 24, 2021

Related U.S. Application Data

(60) Provisional application No. 62/950,983, filed on Dec. 20, 2019.

(51) Int. Cl.
*E21B 34/14* (2006.01)
*E21B 23/14* (2006.01)

(52) U.S. Cl.
CPC ..... *E21B 34/14* (2013.01); *E21B 23/14* (2013.01); *E21B 2200/06* (2020.05); *E21B 2200/22* (2020.05)

(58) Field of Classification Search
CPC .. E21B 23/14; E21B 2200/22; E21B 2200/06; E21B 34/16; E21B 34/14
See application file for complete search history.

(56) References Cited

U.S. PATENT DOCUMENTS

| | | | | |
|---|---|---|---|---|
| 5,549,161 | A | 8/1996 | Gomez et al. | |
| 6,378,627 | B1 | 4/2002 | Tubel et al. | |
| 8,220,555 | B1 | 7/2012 | Wintill et al. | |
| 2005/0072577 | A1* | 4/2005 | Freeman | E21B 34/14 166/66.4 |

(Continued)

FOREIGN PATENT DOCUMENTS

WO 2018004575 A2 1/2018

OTHER PUBLICATIONS

Foucher et al., 2018, Wireline Tractor Advanced Restriction Navigation, SPE-189926-MS, (6 pages).

(Continued)

*Primary Examiner* — Brad Harcourt
(74) *Attorney, Agent, or Firm* — Ashley E. Brown

(57) ABSTRACT

Apparatus and methods for autonomously shifting a downhole sliding sleeve. A shift tool includes a shifter arm, an artificial neural network, and a control circuit. The artificial neural network is trained to identify engagement of the shifter arm with a shifting feature of a sliding sleeve. The control circuit is configured to extend the shifter arm at a first pressure for seeking engagement with the shifting feature of the sliding sleeve, and responsive to the artificial neural network recognizing engagement of the shifter arm with the shifting feature of the sliding sleeve, extend the shifter arm at a second pressure for shifting the sliding sleeve.

14 Claims, 9 Drawing Sheets

(56) References Cited

U.S. PATENT DOCUMENTS

| | | | | |
|---|---|---|---|---|
| 2013/0014939 | A1* | 1/2013 | Martinez | E21B 23/00 166/381 |
| 2013/0118762 | A1 | 5/2013 | Kellner | |
| 2014/0083708 | A1 | 3/2014 | Beck et al. | |
| 2014/0174761 | A1 | 6/2014 | Spencer et al. | |
| 2018/0291708 | A1* | 10/2018 | Akkerman | E21B 34/14 |
| 2020/0040679 | A1 | 2/2020 | Mauchien et al. | |

OTHER PUBLICATIONS

Bi-Directional Shifting Tool, downloaded on May 13, 2021, at http://www.hunting-intl.com/well-intervention-equipment/thru-tubing-technology/fishing-tools/bi-directional-shifting-tool (1 page).

European Extended Search Report issued in EP20215643.6, dated Apr. 21, 2021 (7 pages).

International Search Report and Written Opinion issued in International Patent application PCT/2021/030492 dated Jun. 28, 2021, 9 pages.

* cited by examiner

Database of Class II - aka Dictionary of Expected Events

SYSTEM AND METHOD FOR WIRELINE SHIFTING

CROSS-REFERENCE TO RELATED APPLICATIONS

The present application claims priority to, and the benefit of the earlier filing date of U.S. Provisional Application No. 62/950,983, titled "SYSTEM AND METHOD FOR WIRELINE SHIFTING," filed Dec. 20, 2019, the entirety of which is hereby incorporated herein by reference.

BACKGROUND

In the oil and gas industry, the term wireline usually refers to a cabling technology used to lower equipment or measurement devices into the well for the purposes of well intervention, reservoir evaluation, or pipe recovery. Wireline braided line can contain an inner core of insulated wires which provide power to equipment located at the end of the cable, normally referred to as electric line, and provides a pathway for electrical telemetry for communication between the surface and equipment at the end of the cable.

Wireline mechanical intervention tools are one type of wireline tools. These tools are used to intervene in oil and gas producing wells to alter the state of the well or well geometry, provide well diagnostics, or manage the production of the well. Wireline shifting tools are a sub-category of the mechanical intervention tools.

SUMMARY

Apparatus and methods for autonomously shifting a downhole sliding sleeve are disclosed herein. In one example, a shift tool includes a shifter arm, an artificial neural network, and a control circuit. The artificial neural network is trained to identify engagement of the shifter arm with a shifting feature of a sliding sleeve. The control circuit is configured to extend the shifter arm at a first pressure for seeking engagement with the shifting feature of the sliding sleeve, and responsive to the artificial neural network recognizing engagement of the shifter arm with the shifting feature of the sliding sleeve, extend the shifter arm at a second pressure for shifting the sliding sleeve.

BRIEF DESCRIPTION OF THE DRAWINGS

For a detailed description of various examples, reference will now be made to the accompanying drawings in which.

DETAILED DESCRIPTION

Figure 1:
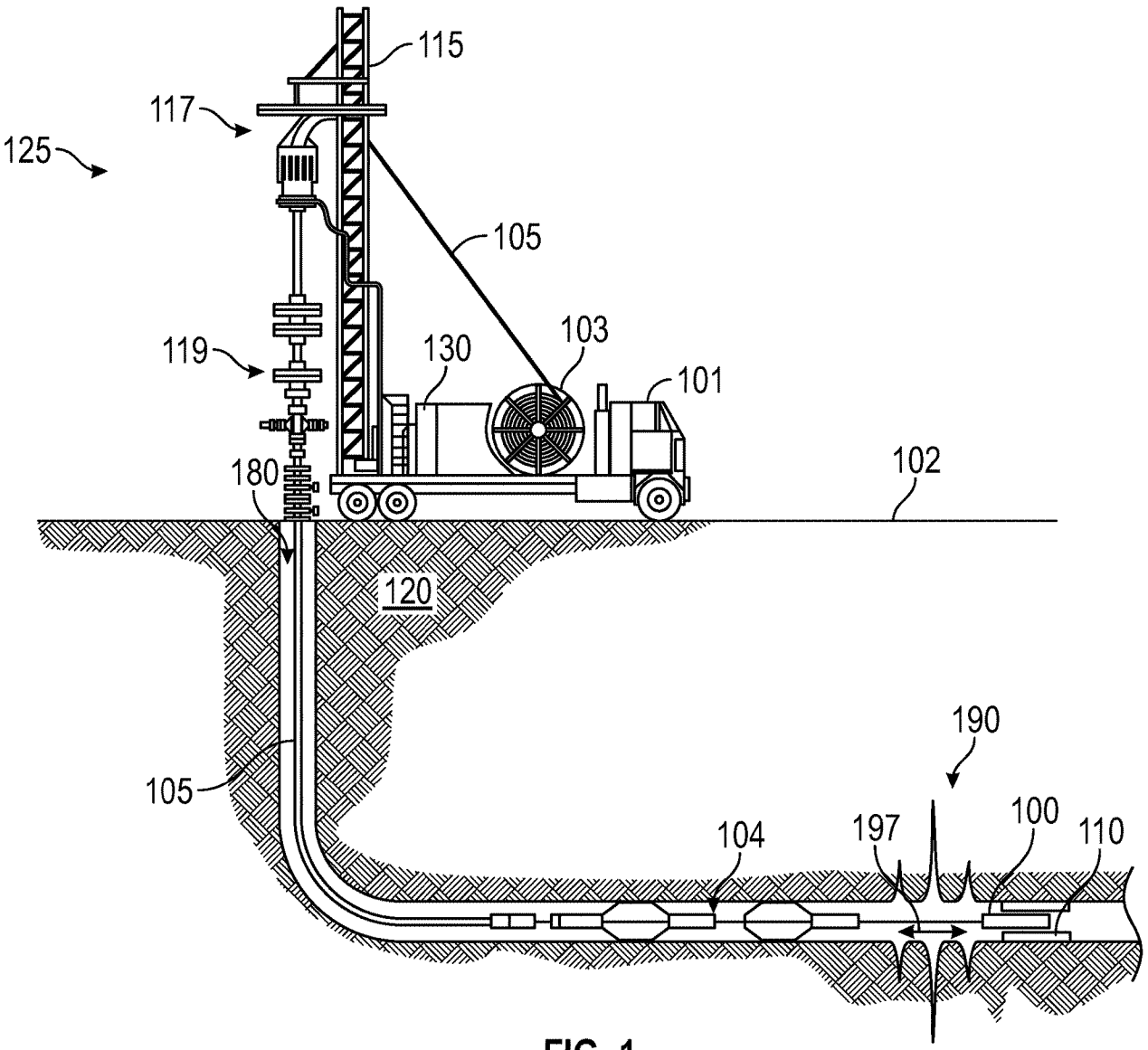
FIG. 1 shows an example application of a shift tool in a well in accordance with the present disclosure.

Certain terms have been used throughout this description and claims to refer to particular system components. As one skilled in the art will appreciate, different parties may refer to a component by different names. This document does not intend to distinguish between components that differ in name but not function. In this disclosure and claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection or through an indirect connection via other devices and connections. The recitation "based on" is intended to mean "based at least in part on." Therefore, if X is based on Y, X may be a function of Y and any number of other factors.

As used herein, the term "sliding sleeve" refers to a downhole completion component used to change fluid flow. For example, actuation of a sliding sleeve may enable or disable fluid communication between tubing and annulus. Sliding sleeves are also applied in Formation Isolation Valves, Flow Control Valves and other downhole completion equipment that can be manipulated using a wireline shifting tool. Formation isolation valves are valves that are opened and closed by pushing or pulling a sliding sleeve that is mechanically connected to the ball valve. Flow control valves are valves that can be opened to a partially open position. They are used to control the flow. The manipulation of a sliding sleeve back and forth controls the percentage of opening of the flow control valve.

Over the life of the well, as certain zones begin to become depleted, produce water or require some form of remediation, an intervention may be performed. For example, where a zone of concern is outfitted with a sliding sleeve, an intervention with a shifting tool may take place whereby the tool is directed to the sleeve to manipulate a closure of the sleeve. As such, the zone may be closed off in a manner that allows continued production to come from more productive, less contaminant prone, adjacent zones.

Shifting tools are used to exercise or shift downhole valves and sliding sleeves by utilizing an anchoring system, a pulling or pushing load provided by a linear actuator, tractor system, or wireline cable, and a shifter tool for latching onto a completion shifting profile. Shifting tools are expected to be compatible with numerous sliding sleeve and valve types with different latching profiles, making the operation of the tool a bit different from job to job. However, once characterized, a particular type of completion equipment shifting operation should be very repeatable.

A wireline engineer is usually in charge of lowering the shifting tool into the wellbore and operating the shifting tool. This requires that the engineer be extensively trained (which increases the cost of operations), and even with proper training, shifting operations are complex and susceptible to human error. Implementations of the wireline shifting system disclosed herein include a controller coupled to the shifting tool. The controller manages operation of the shifting tool to reduce reliance on a human operator, thereby reducing operational costs and improving operation outcomes. In various implementations of the wireline shifting system, the controller is embedded in the shifting tool or disposed at the surface. Operations managed by the controller include seeking the location of the sleeve to be shifted and executing a shifting operation. The seeking operation includes searching for and latching the shifting tool onto a shifting feature of a sleeve. The shifting operation includes moving the sleeve to a different position by pushing or pulling. Some implementations may provide a hierarchical control structure in which an inner layer controls seek and shift operations, and an outer layer controls operations affect the tool string as a whole.

FIG. 1 shows an example application of a shift tool in a well in accordance with the present disclosure. The well 180 traverses a formation 120 and extends into a horizontal section which includes a production region 190. Due to the non-vertical architecture of the well 180, tractor conveyance, provided by the tractor 104, may be utilized in addition to the wireline 105. The shift tool 100 may be utilized in wells displaying a variety of different types of architectures and similarly conveyed through a host of different types of conveyances. While both wireline 105 and tractor 104 conveyances are depicted in FIG. 1, in other embodiments, one form of conveyance may be utilized in lieu of the other. For example, the shift tool 100 may be deployed via a wireline cable (with or without the tractor 104), via drill pipe or via a battery powered slickline embodiment.

Surface equipment 125 located at the oilfield 102 may include a wireline truck 101 accommodating a winch-operated wireline reel 103 and control unit 130 for directing the operation. Similarly, a mobile rig 115 is provided for supporting a conventional gooseneck injector 117 for receipt of the wireline 105. Thus, the wireline 105 may be driven through standard pressure control equipment 119, as it is advanced toward the production region 190. In embodiments where the shift tool 100 is deployed on a wireline cable, drill pipe, or slickline, suitable surface equipment will be utilized. In the illustrated example, the production region 190 may be producing water or some other contaminant, or having some other adverse impact on operations.

Figure 2:
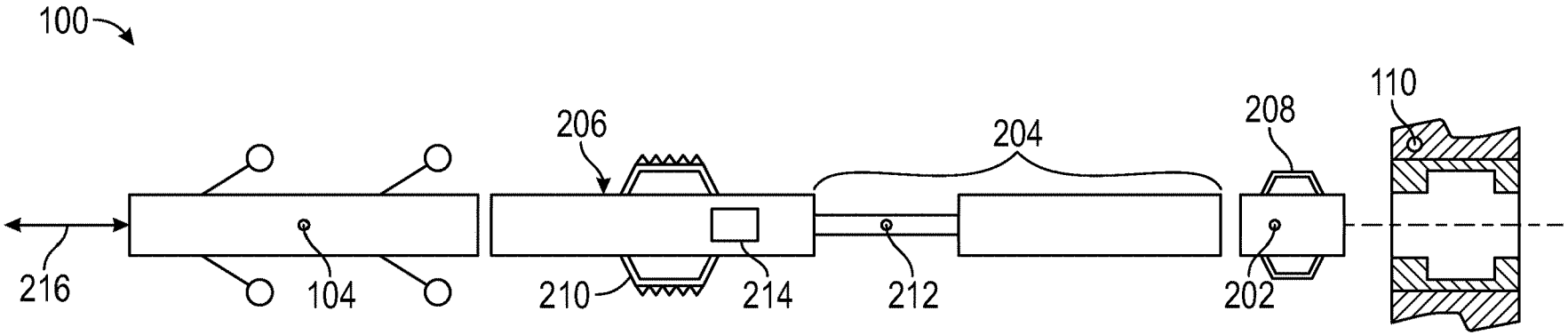
FIG. 2 shows an example shift tool in accordance with the present disclosure.

The shift tool 100 may be delivered to the site of the sliding sleeve 110 so as to close off or open up production from the production region 190 by shifting the sliding sleeve 110 in one or other direction illustrated by the arrow 197. FIG. 2 shows an example of the shift tool 100 in accordance with the present disclosure. The shift tool 100 includes a shifting system 202, a linear actuator 204, and an anchoring system 206. Some implementations of the shift tool 100 may also include the tractor 104. The shifting system 202 includes radially expansive shifting arms 208 that radially extend from the body of the shifting system 202 to engage the sliding sleeve 110. The anchoring system 206 includes radially expansive anchoring arms 210 that radially extend from the body of the anchoring system 206 to engage casing or tubing disposed in the well 180. The linear actuator 204 provides axial force to push or pull (by extending or retracting rod 212) the shifting system 202. The anchoring arms 210 hold the anchoring system 206 in place while shifting arms 208 engage the sliding sleeve 110, and the shifting system 202 is pushed or pulled by the linear actuator 204 to reposition the sliding sleeve 110.

The shift tool 100 also includes a controller 214 that controls the extension and retraction of the anchoring arms 210, the extension and retraction of the shifting arms 208, the extension and retraction of the rod 212, and in some implementations of the shift tool 100, the operation of the tractor 104. The controller 214 may communicate with the control unit 130 and/or other surface control systems via the electrical conductors 216, which extend from the surface to the shift tool 100.

In some implementations of the shift tool 100, the controller 214 autonomously controls identification of the sliding sleeve 110, positioning of the shifting arms 208 in the sliding sleeve, actuation of the anchoring arms 210, and repositioning of the sliding sleeve 110 by extension/retraction of the linear actuator 204 and/or operation of the tractor 104. In some embodiments of the shift tool 100, the control unit 130 disposed at the surface receives sensor measurements from the shift tool 100 and autonomously controls seeking and shifting the sliding sleeve 110 via communication with the controller 214.

Figure 3:
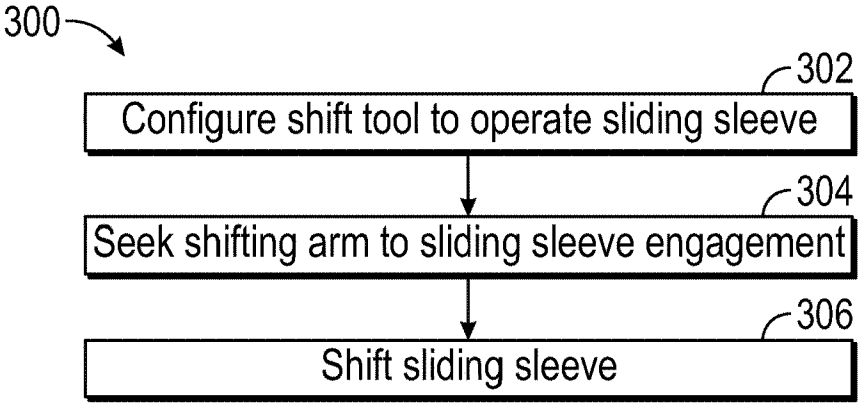
FIG. 3 shows a flow diagram for an example method for operating a shift tool in accordance with the present disclosure.

FIG. 3 shows a flow diagram for an example method 300 for operating an implementation of the shift tool 100. Though depicted sequentially as a matter of convenience, at least some of the actions shown can be performed in a different order and/or performed in parallel. Additionally, some implementations may perform only some of the actions shown.

In block 302, the shift tool 100 is configured to operate the sliding sleeve 110. The configuration may include providing to the shift tool 100 with information that identifies the sliding sleeve 110 and/or operational parameters thereof, information that identifies the well casing proximate the sliding sleeve 110, etc. For example, configuration of the shift tool 100 may include identifying a specific type of sliding sleeve 110 thereby allowing the controller 214 to retrieve parameters of an engagement feature, slide activation distance, neural network weights to apply for recognition of sliding sleeve features and operation, etc. In other implementations, configuration may include providing neural network weights pertinent to the sliding sleeve 110, sliding sleeve parameters, and/or casing parameters to the controller 214 via the electrical conductors 216 or other communication medium.

In block 304, the shift tool 100 is disposed in the well 180 and positioned in the vicinity of the sliding sleeve 110. For example, the wireline 105, the tractor 104 or other device is employed to move the shift tool 100 in the well 180 to a location near the sliding sleeve 110. Once positioned in the vicinity of the sliding sleeve 110, the control unit 130 may activate the shift tool 100 to autonomously seek and shift the sliding sleeve 110. For example, the control unit 130 may transmit a command to the shift tool 100 to activate seek and shift operations. Responsive to activation, the shift tool 100 attempts to engage the shifting arms 208 with the sliding sleeve 110. Additional information regarding the seek operation is provided with reference to FIG. 4 and associated text.

When the shift tool 100 has successfully engaged the shifting arms 208 with the sliding sleeve 110, the shift tool 100 transitions from the seek mode to a shift mode, and applies force to the sliding sleeve 110 via the shifting arms 208 to shift the position of the sliding sleeve 110 and modify operation of the downhole equipment associated with the sliding sleeve 110. Additional information regarding the shift operation is provided with reference to FIG. 5 and associated text.

Figure 4:
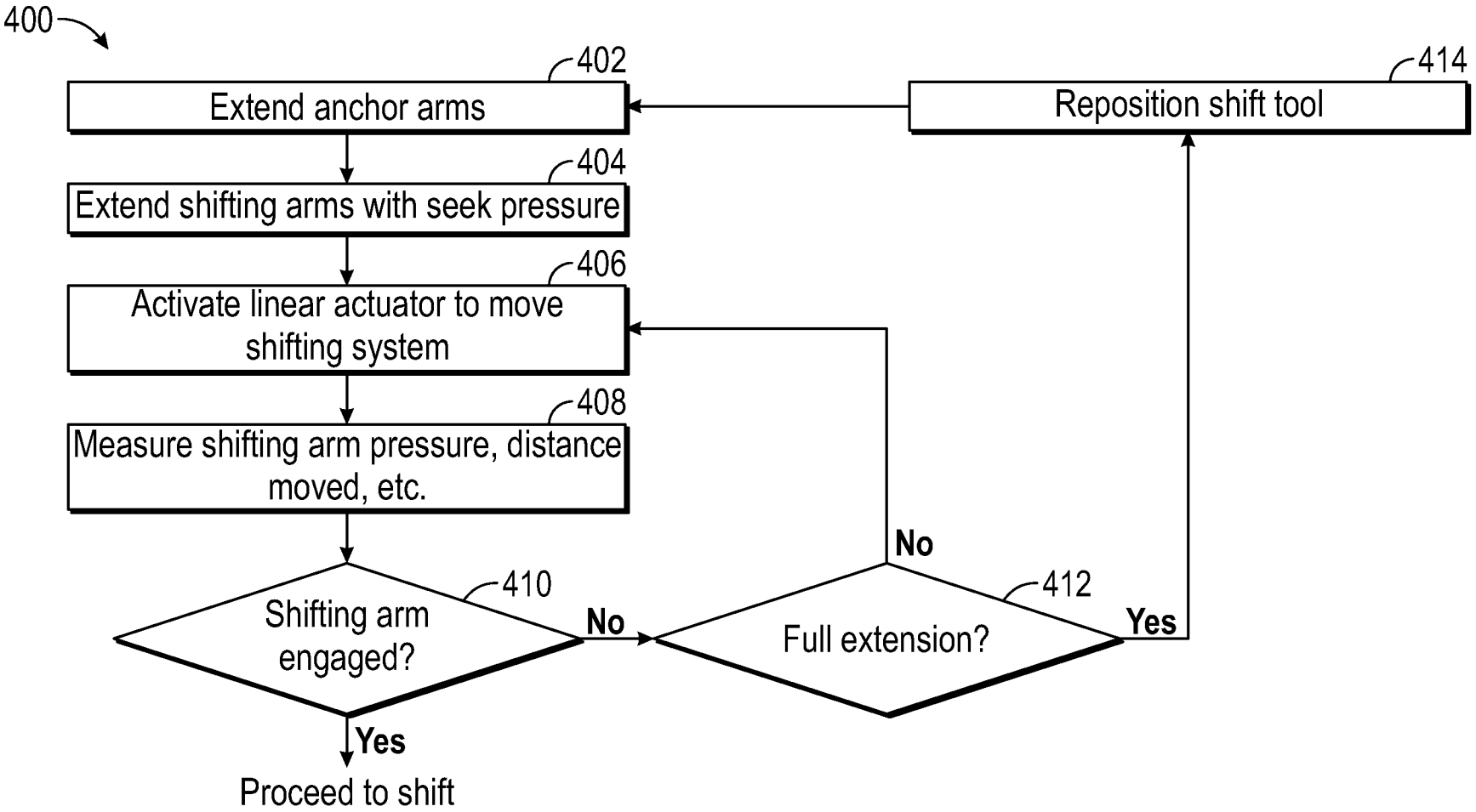
FIG. 4 shows a flow diagram for an example method for executing a seek operation to locate a sliding sleeve in accordance with the present disclosure.

FIG. 4 shows a flow diagram for an example method 400 for executing a seek operation to locate a sliding sleeve. Though depicted sequentially as a matter of convenience, at least some of the actions shown can be performed in a different order and/or performed in parallel. Additionally, some implementations may perform only some of the actions shown. Operations of the method 400 may be performed by an implementation of the shift tool 100 as part of the operations of block 304 of the method 300.

In block 402, the shift tool 100 has been positioned in the vicinity of the sliding sleeve 110, and has received a command (e.g., the controller 214 has received the command) to autonomously seek and shift the sliding sleeve 110. In the shift tool 100, the controller 214 causes the anchoring system 206 to extend the anchoring arms 210 to engage the well casing and hold the shift tool 100 in place. The pressure applied by the anchoring arms 210 to engage the case may be specified by a parameter programmed into the controller 210 based on the parameters of the casing.

In block 404, the controller 214 causes the shifting system 202 to extend the shifting arms 208. The pressure applied to the shifting arms 208 may be relatively low (e.g., low enough to allow movement of the shifting system 202 while the shifting arms 208 are in contact with an inner surface of the sliding sleeve 110).

In block 406, the controller 214 causes the linear actuator 204 to extend or retract the rod 212, which, in turn, moves the shifting system 202 in the direction of rod movement.

In block 408, as the shifting system 202 moves within the well 180, sensors in the shift tool 100 measure the extent (distance) and speed of movement of the shifting system 202, force applied to move the shifting system 202, and the pressure applied by the shifting arms 208 to the interior surface of the sliding sleeve 110.

In block 410, the controller 214 determines, based on measurements of the force applied to move the shifting system 202 and/or the pressure applied by the shifting arms 208 to the interior of the sliding sleeve 110, whether the shifting arms 208 are engaged with a shifting feature of the sliding sleeve 110. For example, a time series of pressure and/or force measurements may be processed in an artificial neural network (ANN) or other machine learning model trained to identify engagement of the shifting arms 208 with the sliding sleeve 110 based on the measurements.

If the controller 214 determines that the shifting arms 208 are engaged with the sliding sleeve 110, then the controller 214 transitions the shift tool 100 from seek mode to shift mode (i.e., transitions from block 304 to block 306 of the method 300).

If the controller 214 determines that the shifting arms 208 are not engaged with the sliding sleeve 110, then, in block 412, the controller 214 determines whether the rod 212 is fully extended/retracted, or extended/retracted to a predetermined length at which the extension/retraction is to be halted. If the rod 212 has not been extended/retracted to the predetermined length, then the rod 212 is further extended/retracted to continue movement of the shifting system 202 in block 406.

If, in block 412, the controller 214 determines that the rod 212 is extended/retracted to the predetermined length, then the controller 214 repositions the shift tool 100 within the well 180 to continue searching for the sliding sleeve 110 in block 414. For example, the controller 214 may cause the anchoring system 206 to retract the anchoring arms 210, cause the shifting system 202 to retract the shifting arms 208, and cause the tractor 104 to reposition the shift tool 100 (e.g., move the shift tool 100 a predetermined distance in a predetermined direction). In some implementations, rather than using the tractor 104, the controller 214 may communicate with the control unit 130 to have the control unit 130 move the shift tool 100 by operation of a winch. After the shift tool 100 has been repositioned, the controller 214 operates the shift tool 100 to continue seeking engagement of the shifting arms 208 with the sliding sleeve 110 in block 402.

In some implementations of the method 400 for executing a seek operation, movement of the shifting system 202 and/or repositioning of the shift tool 100 is provided by operation of the tractor 104 (controlled by the controller 214 or the control unit 130) or the winch-operated wireline reel 103 (controlled by the control unit 130. In some implementations, the shift tool 100 may be repositioned by extending the shifting arms 208 to hold the shifting system 202 in place, retracting the anchoring arms 210 to allow movement of the anchoring system 206, and extending or retracting the rod 212 to move the anchoring system 206.

Figure 5:
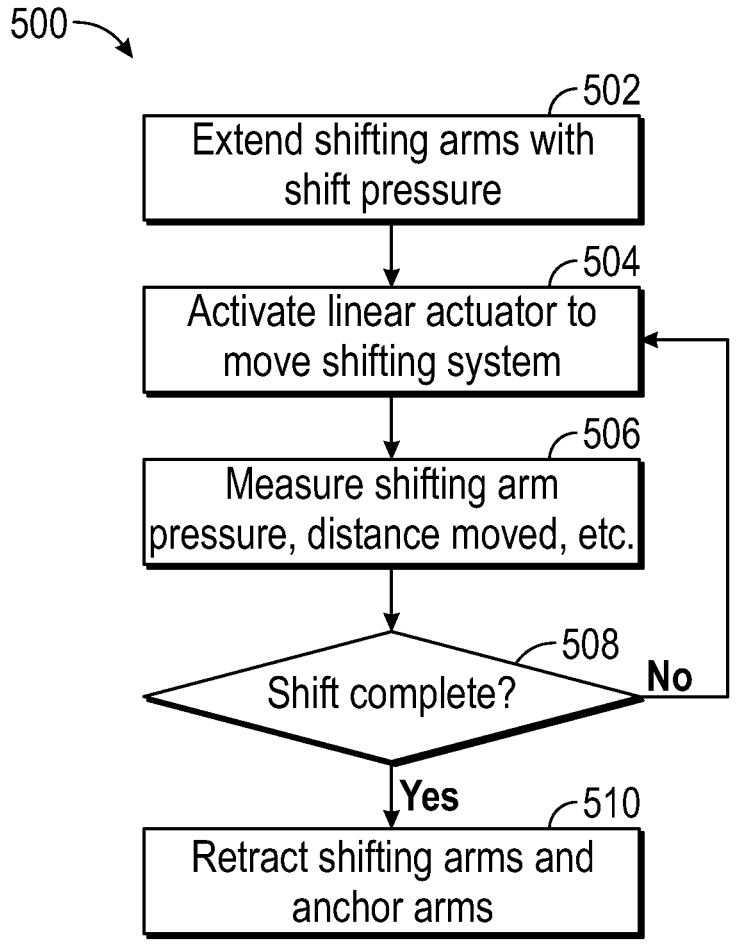
FIG. 5 shows a flow diagram for an example method for executing a shift operation to reposition a sliding sleeve in accordance with the present disclosure.

FIG. 5 shows a flow diagram for an example method 500 for executing a shift operation to reposition a sliding sleeve in accordance with the present disclosure. Though depicted sequentially as a matter of convenience, at least some of the actions shown can be performed in a different order and/or performed in parallel. Additionally, some implementations may perform only some of the actions shown. Operations of the method 500 may be performed by an implementation of the shift tool 100 as part of the operations of block 306 of the method 300.

In block 502, the shifting arms 208 of the shift tool 100 are engaged with a shifting feature of the shifting system 202. The controller 214 extends the shifting arms 208 to a pressure that allows the shifting tool 100 to remain engaged with the sliding sleeve 110 while the shift tool 100 repositions the sliding sleeve 110. For example, the controller 214 may cause the shifting system 202 to increase the pressure applied by the shifting arms 208 from the pressure applied to seek engagement in block 304 of the method 300 to a higher pressure suitable for shifting the sliding sleeve 110.

In block 504, the controller 214 causes the linear actuator 204 to extend or retract the rod 212, which, in turn, moves the shifting system 202 and the sliding sleeve 110 in the direction of rod movement.

In block 506, as the shifting system 202 and the sliding sleeve 110 move within the well 180, sensors in the shift tool 100 measure the extent (distance) and speed of movement of the shifting system 202, the force applied to move the shifting system 202, and the pressure applied by the shifting arms 208 to the interior surface of the sliding sleeve 110.

In block 508, the controller 214 determines, based on measurements acquired in block 506, whether repositioning of the sliding sleeve 110 is complete. For example, a time series of pressure measurements and measurements of force and extension of the rod 212 may be processed in an artificial neural network (ANN) or other machine learning model trained to identify completion of shifting of the sliding sleeve 110 based on the pressure, force and/or extension measurements.

If, in block 508, the controller 214 determines that the sliding sleeve 110 has been fully repositioned, then the controller 214 causes the shifting system 202 to retract the shifting arms 208 and causes the anchoring system 206 to retract the anchoring arms 210 in block 510.

If, in block 508, the controller 214 determines that the sliding sleeve 110 has not been fully repositioned, then the controller 214 causes the linear actuator 204 to continue moving the sliding sleeve 110 in block 504.

Implementations of the controller 214 embed pattern recognition into the feedback of the control and use chunks of dynamically (in-situ, in run-time, in real-time) obtained waveforms—"words" from a pre-created {arm, target} pairs dictionary—rather than static analysis of longer recordings by software when it may be too late for the decisions and manipulations. In a general sense, the controller can be considered as handling electromechanical tools falling into the category of machines with motion controllable by patterns produced as a result of such the motion, so in this sense the controller provides closed-loop control with feedback from an artificial neural network ANN). In one implementation, the controller acquires waveforms, processes the waveforms through an ANN-based parser to detect mechanical events, and uses a preprogrammed event-to-action map to select a further actuation step and generate a status.

Figure 6:
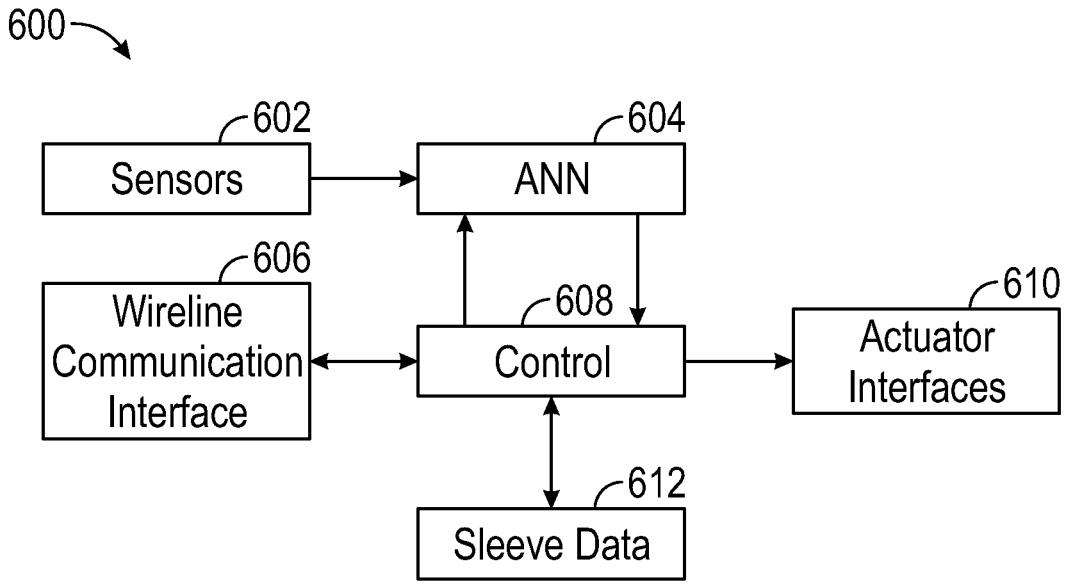
FIG. 6 shows a block diagram for an example of a control system suitable for use in a shift tool in accordance with the present disclosure.

FIG. 6 shows a block diagram for an example of a control system 600 suitable for implementing the controller 214. The control system 600 includes sensors 602, an ANN 604, a control circuit 608, a wireline communication interface 606, actuator interfaces 610, and sleeve data 612. The sensors 602 may include a pressure sensor to measure pressure or force applied by the anchoring arms, a pressure sensor to measure pressure applied by the shifting arms, a length sensor to measure extension of the rod 212, a speed sensor to measure velocity of the rod 212, a force sensor to measure force applied to move the rod 212; temperature sensors, and/or other sensors.

Measurement values generated by the sensors 602 are provided to the ANN 604. The ANN 604 may be a convolutional neural network or other machine learning model.

The wireline communication interface 606 allows the control circuit 608 to communicate with the control unit 130. For example, the control circuit 608 may pass measurement values and or seek/shift state information to the control unit 130 via the wireline communication interface 606, and/or the control circuit 608 may receive commands and/or configuration information from the control unit 130 via the wireline communication interface 606.

The control circuit 608 may include a processor or state machine configured to manage seek and shift operations of the shift tool 100. The control circuit 608 may provide weight values to the ANN 604 for configuring the ANN 604 to recognize, based on the measurements provide by the sensors 602, engagement of the shifting arms 208 with the sliding sleeve 110 (e.g., recognize start and end of a seek operation), and to recognize shifting of the sliding sleeve 110 (e.g., recognize start and end of a shift operation). The sleeve data 612 includes the weight values for configuring the ANN 604 to recognize successful seeking and successful shifting for each of a plurality of different sliding sleeves that the shift tool 100 can manipulate. The weight values and other parameters of the sleeve data 612 may be associated with a selection index for each different sliding sleeve that may be manipulated by the shift tool 100.

The control circuit 608 communicates with the actuator interfaces 610 to control the shifting arms 208, the anchoring arms 210, the rod 212, the tractor 104, and/or other components of the shift tool 100. For example, via the actuator interfaces 610, the control circuit 608 may control hydraulic valves, hydraulic pumps, solenoids, motors, etc. that in-turn control the extension/retraction of the shifting arms 208, the anchoring arms 210, the rod 212, and tractor 104.

In some implementations of a shifter system, portions of the control system 600 may be disposed in the control unit 130 rather than the controller 214. For example, the ANN 604, the control circuit 608, and the sleeve data 612 may be disposed in the control unit 130. In such implementations, the control unit 130 receives sensor measurements from the controller 214 and provides commands for controlling the shift tool 100 to the controller 214 via the electrical conductors 216 to operate the shift tool 100 autonomously.

Figure 7:
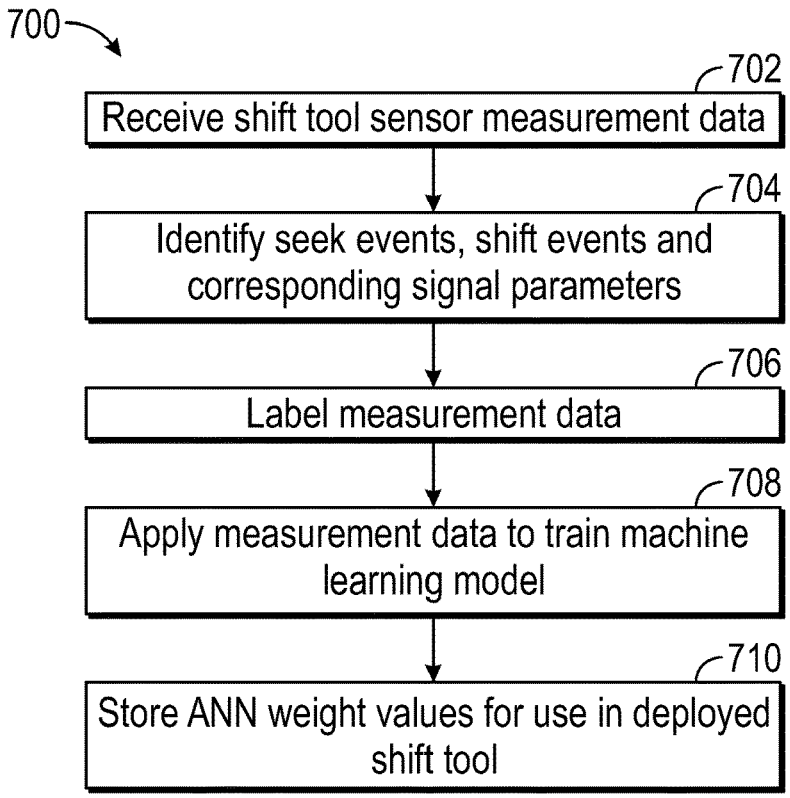
FIG. 7 shows a flow diagram for an example method for machine learning in accordance with the present disclosure.

FIG. 7 shows a flow diagram for an example method 700 for machine learning in accordance with the present disclosure. Though depicted sequentially as a matter of convenience, at least some of the actions shown can be performed in a different order and/or performed in parallel. Additionally, some implementations may perform only some of the actions shown. Operations of the method 700 may be performed by the control unit 130, the shift tool 100, or other computing device.

At step 702, shift tool operational data is received. The operational data may include operational parameters (e.g., sleeve shift feature location, sleeve shift distance, etc.) and measurements of shift arm pressure, force, and offset during seek and shift operations for a variety of different sliding sleeves. The measurements may be acquired while operating the shift tool 100 or another shift tool to operate the sliding sleeve. Avoidance of outliers and reasonable level of discrimination of local waveform variations not representing an actual physical process may be provided by acquiring as many recorded waveforms as possible for use in training, and by preprocessing and conditioning the signals through Fast Fourier Transform, wavelets, etc.

At step 704, the operational data is analyzed to identify seek start, seek end, shift start, shift end, and other operational conditions in operation of the shift tool in the sliding sleeve. Operational data may be acquired in a variety of different conditions. Pressures, and changes thereof, are analyzed to identify seek and shift parameters. For example, increases and/or decreases in pressure associated with seek start, seek end, shift start, shift end are identified. The training signals may be normalized (e.g., using wavelet-based "wrapping" methods) based on temperature, speed of linear motion, pressure, linear actuator motion, RPM of a hydraulic pump, etc.

In step 706, the operational data is labeled to identify features, such as seek start, seek end, shift start, shift end, and measurement parameters relevant thereto. Features may include signal segments and process-representative parameters derived through signal processing of a different kind (Fast Fourier Transform (FFT), Wavelet, statistical, Hilbert-Huang transform, etc.).

In step 708, the labeled operational data is applied to train a machine learning model to identify successful seek and shift operations (e.g., seek start, seek end, shift start, shift end). The training may include applying the labeled operational data to generate weight values in the machine learning model by back-propagation.

The step 710, the weight values generated by training are stored for use in a deployed shift tool 100.

The steps of the method 700 may be repeated as needed to update the training of the machine learning model and improve recognition of successful seek and shift operations. For example, the method 700 may be repeated as the shift tool 100 operates in the well 180, using measurements collected during the operation of the shift tool 100, to improve recognition of seek and shift operations.

Figure 8:
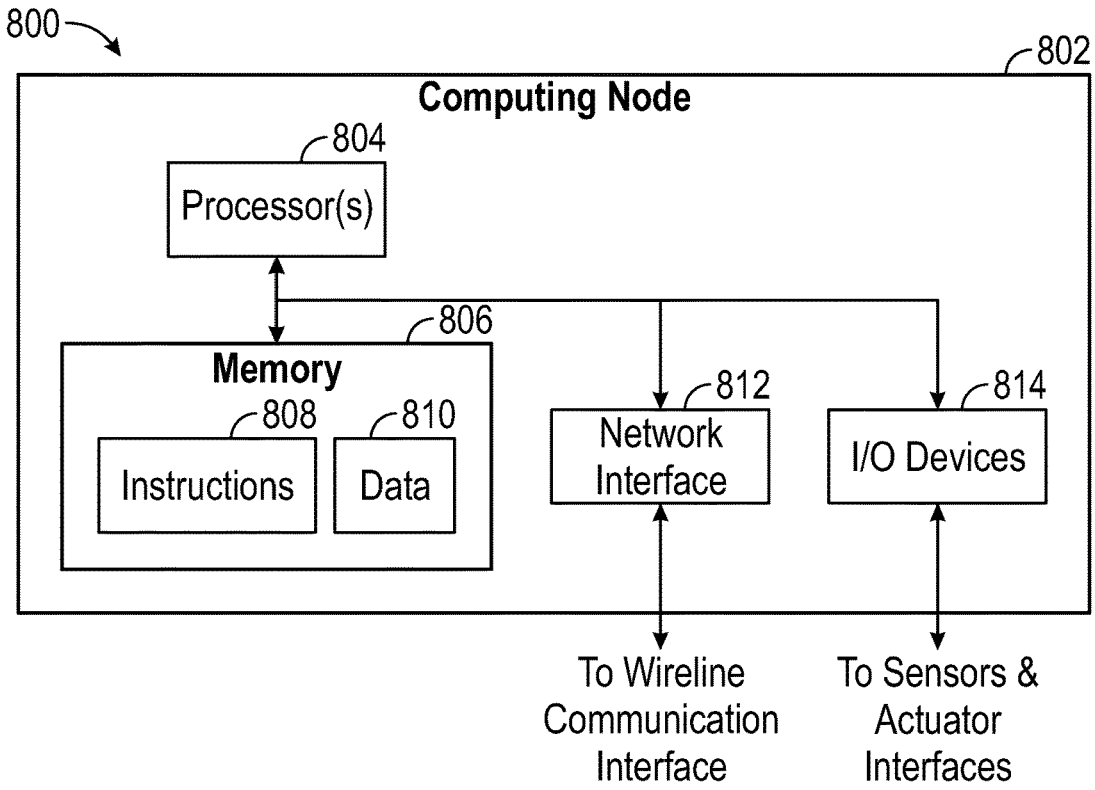
FIG. 8 shows a block diagram for a computing system suitable for implementing a controller for operating a shift tool in accordance with the present disclosure.

FIG. 8 shows a block diagram for a computing system 800 suitable for implementing a controller for a shift tool in accordance with the present disclosure. For example, the computing system 800 may be applied to implement the control unit 130 or the controller 214, including the ANN 604 and the control circuit 608. The computing system 800 includes one or more computing nodes 802. Each computing node 802 includes one or more processors 804 coupled to memory 806, a network interface 812, and one or more I/O devices 814. In various embodiments, a computing node 802 may be a uniprocessor system including one processor 804, or a multiprocessor system including several processors 804 (e.g., two, four, eight, or another suitable number). Processors 804 may be any suitable processor capable of executing instructions. For example, in various embodiments; processors 804 may be general-purpose or embedded microprocessors, graphics processing units (GPUs), digital signal processors (DSPs) implementing any of a variety of instruction set architectures (ISAs). In multiprocessor systems, each of the processors 804 may commonly; but not necessarily, implement the same ISA.

The memory 806 may include a non-transitory, computer-readable storage medium configured to store program instructions 808 and/or data 810 accessible by processor(s) 804. The memory 806 may be implemented using any suitable memory technology, such as static random-access memory (SRAM), synchronous dynamic RAM (SDRAM), nonvolatile/Flash-type memory; or any other type of memory. Program instructions 808 and data 810 implementing the functionality disclosed herein are stored within memory 806. For example, program instructions 808 may include instructions that when executed by processor(s) 804 implement the functionality of the controller 214 or the control unit 130 as disclosed herein. Data stored in the memory 806 may include the weight values for configuring the ANN 604 or other parameters of the sliding sleeve 110 (sleeve data 612) applied by the controller 214 to implement seek and shift operations. Data may be stored in the form of a relational; object-oriented, or other database on some implementations.

The computing system 800 may also include secondary storage, which may be implemented using volatile or non-volatile storage and storage devices for storing information such as program instructions and/or data as described herein for implementing the controller 214 or the control unit 130. The secondary storage may include various types of computer-readable media accessible by the computing node 802. A computer-readable medium may include storage media or memory media such as semiconductor storage, magnetic or optical media, e.g., disk or CD/DVD-ROM, or other storage technologies.

The network interface 812 includes circuitry configured to allow data to be exchanged between computing node 802 and/or other devices coupled to a network. For example, the network interface 812 may be configured to allow data to be exchanged between the controller 214 and the control unit 130 via the wireline communication interface 606, different instances of the computing node 802, etc. The network interface 812 may generally support communication via wired or wireless data networks.

The I/O devices 814 allow the computing node 802 to communicate with devices external to the computing node 802. Such external devices may include the sensors 602, the actuator interfaces 610, display terminals, keyboards, keypads, touchpads, scanning devices, voice or optical recognition devices, or any other devices suitable for entering or retrieving data by the computing node 802. Multiple input/output devices may be present in a computing system 800.

Figure 9A:
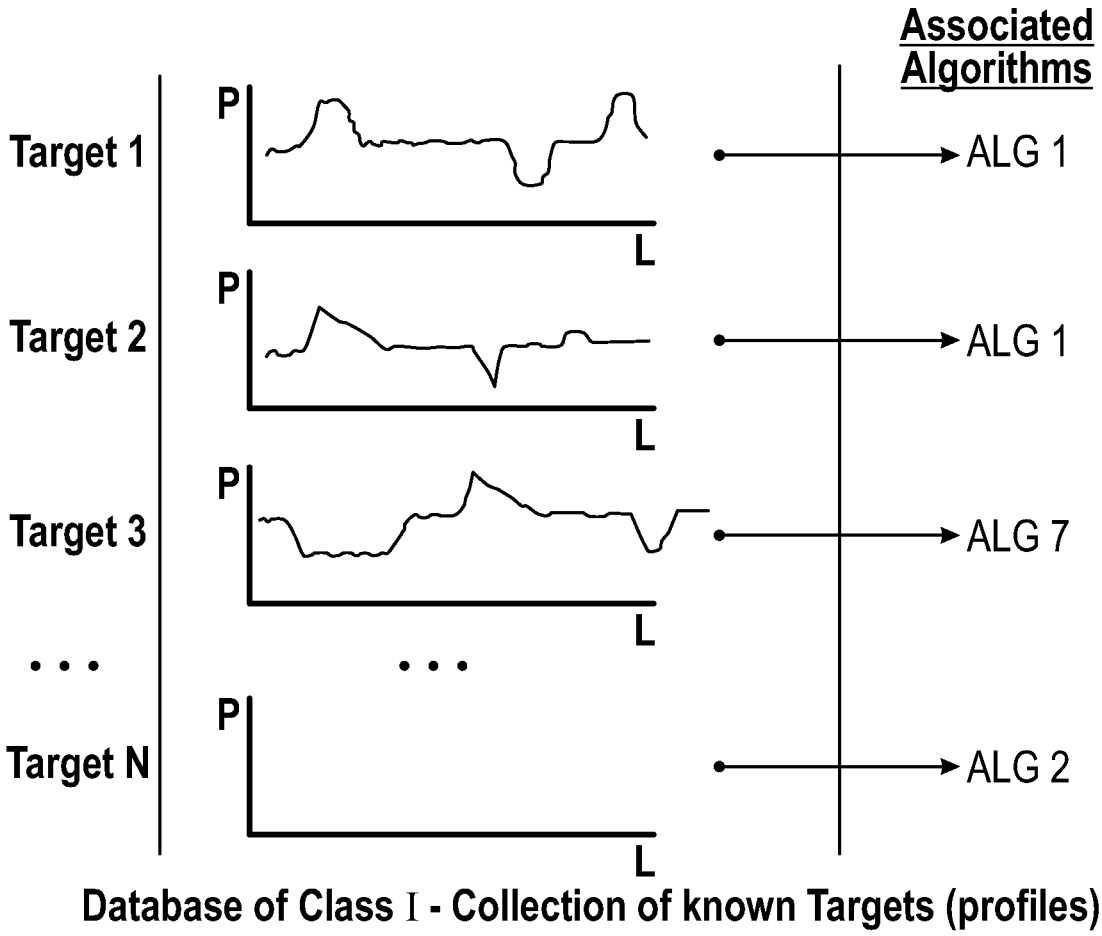
FIGS. 9A-9C show examples of signals applied to train and operate a shifter tool in accordance with the present disclosure.

FIG. 9A shows examples of signals produced by operation of different sliding sleeves that may be suitable for training the ANN 604. The signals represent shifting arm pressure versus distance traveled to seek and shift the sliding sleeve. Each type or model of sliding sleeve may exhibit different pressure versus distance parameters. The signals as whole may be applied to train the ANN 604 to recognize sliding sleeve operation.

Figure 9B:
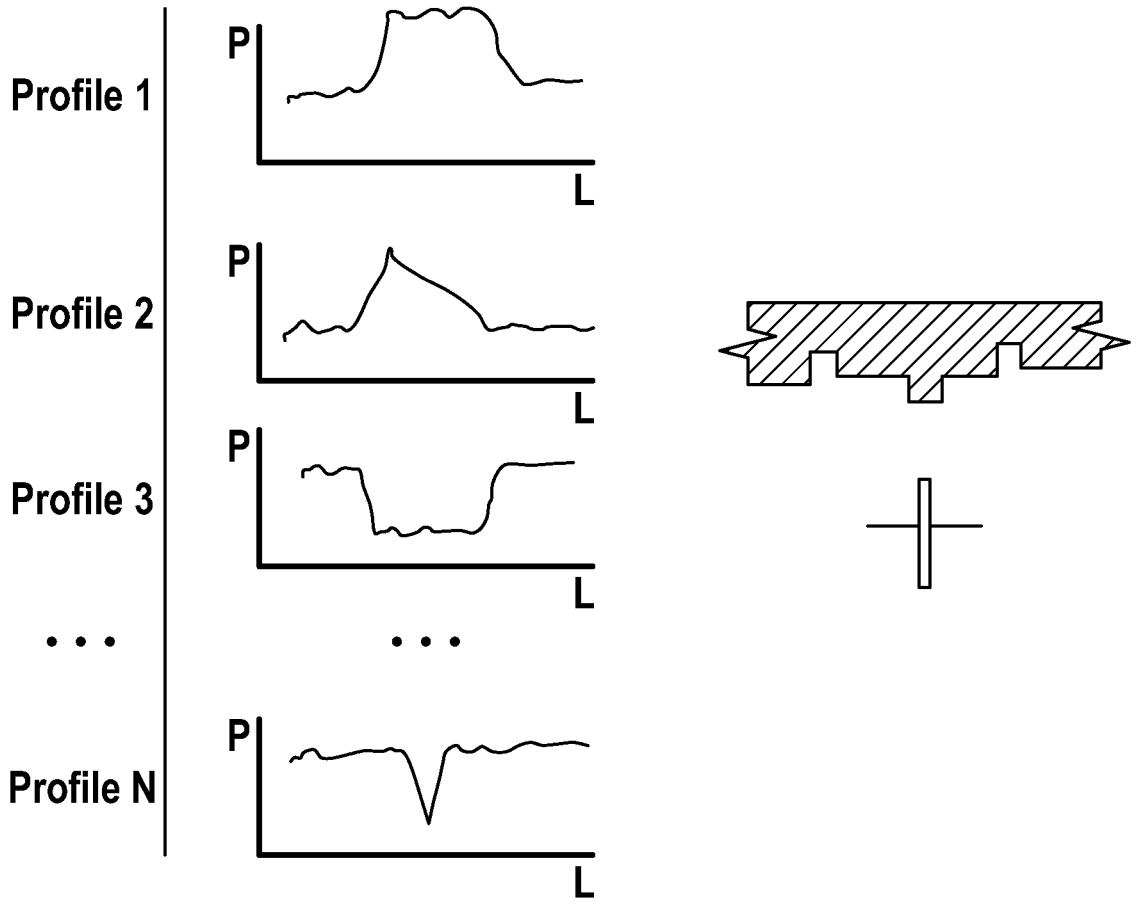

FIG. 9B shows fragments of the signals of FIG. 9A that may be applied to train the ANN 604 to represent discrete events occurring in operation of the various different sliding sleeves. Training for recognition of each of the fragments may be combined as needed to configure the ANN 604 to recognize a series of signals expected to be generated during operation of a sliding sleeve. In such cases, the data stored (e.g., in the control unit 130) to configure the shift tool 100 may be described as a dictionary of events, where training (e.g., weight values) for recognition of different events or features may be concatenated to configure the ANN 604 to recognize a pattern or series of events expected to occur when operating the sliding sleeve.

Figure 9C:
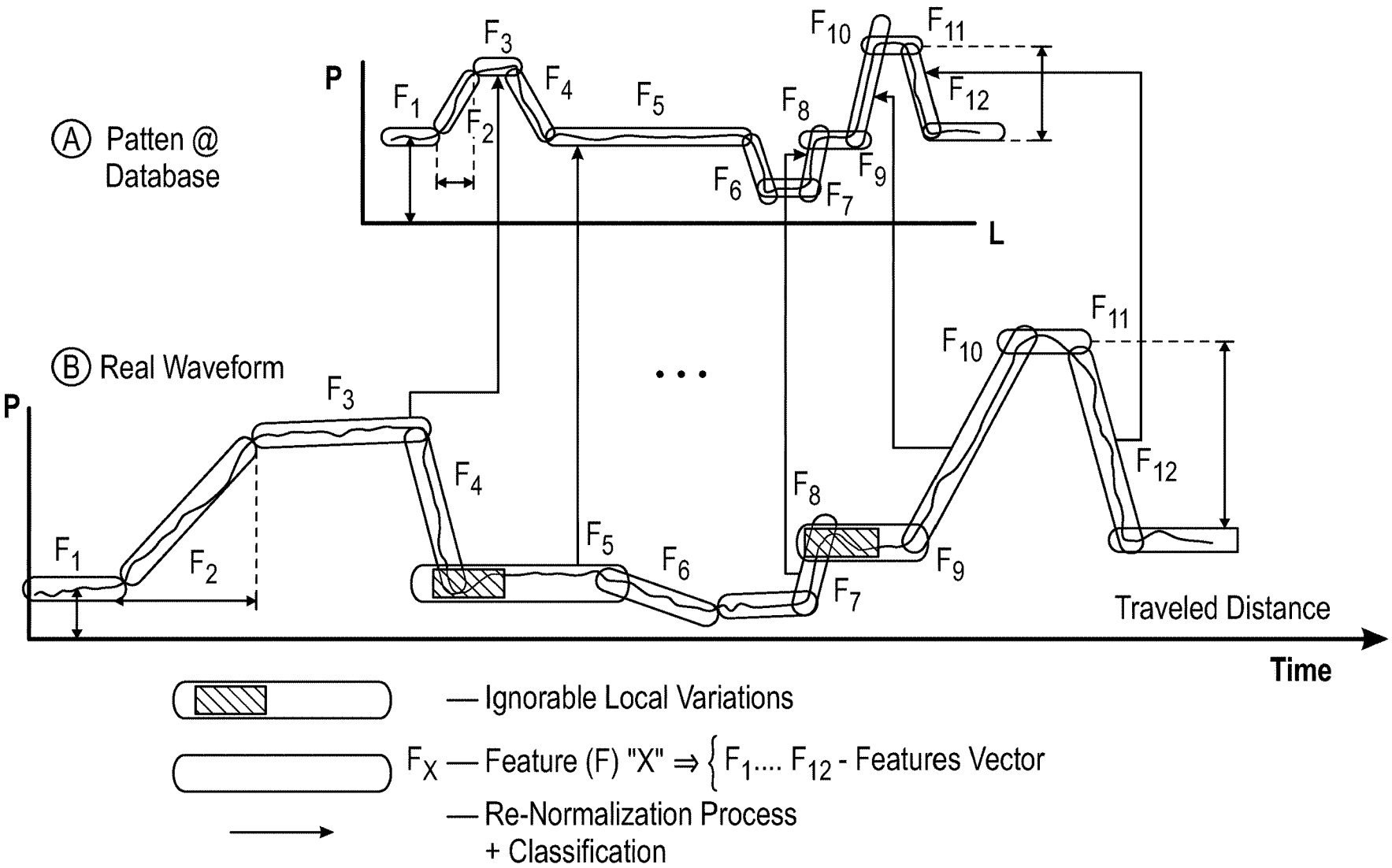

FIG. 9C shows a comparison of a training signal and a signal generated in operation of the shift tool 100 with the various features that may be recognized by the ANN 604 based on the weight values applied to configure the ANN 604.

Figure 9D:
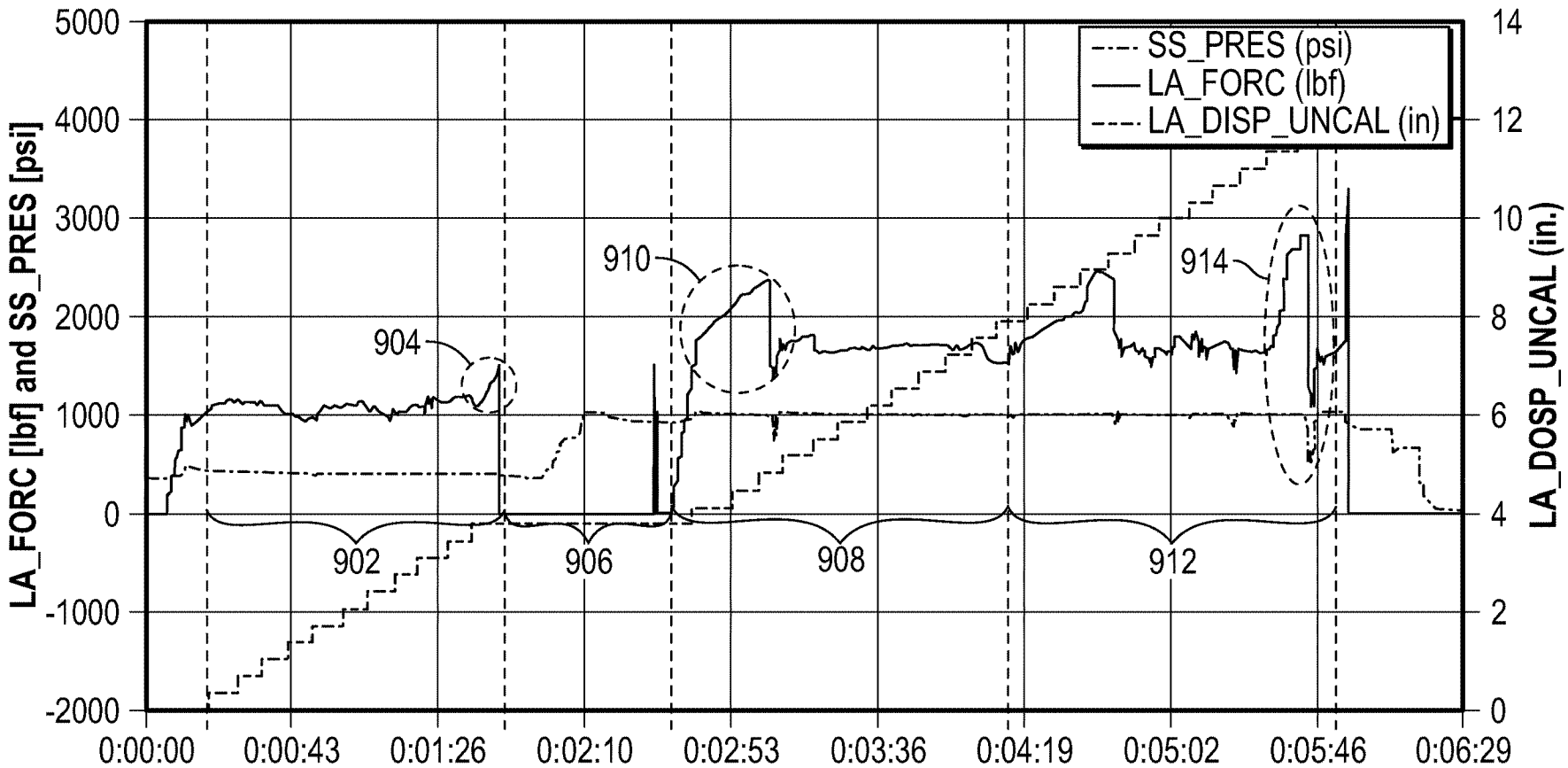
FIG. 9D shows an example of pressure, force, and displacement signals generated by operation of a shift tool in accordance with the present disclosure.

FIG. 9D shows an example of pressure, force, and displacement signals generated in operation of a shift tool in accordance with the present disclosure. In the interval 902, the controller 214 has extended shifting arms 208 with pressure suitable for seeking engagement of the shifting arms 208 with a shifting feature of the sliding sleeve 110, and configured the ANN 604 to recognize the engagement. The shifting system 202 is advanced (by operation of the linear actuator 204) until the ANN 604 recognizes engagement of the shifting arms 208 with a shifting feature of the sliding sleeve 110 at 904.

Responsive to recognition of the engagement of the shifting arms 208 with a shifting feature of the sliding sleeve 110, the controller 214 increases the pressure applied to extend the shifting arms 208 to a pressure suitable for shifting the sliding sleeve 110 in interval 906, and configures the ANN 604 to recognize shifting of the sliding sleeve 110.

In interval 908, the shifting system 202 is further advanced to shift the sliding sleeve 110. Force applied to advance the shifting system 202 increases in interval 910 to initiate movement of the sliding sleeve 110. Extension continues in interval 912 as advancement of the shifting system 202 causes the shifting arms 208 to disengage from the shifting feature of the sliding sleeve 110 in the interval 912.

At 914, the ANN 604 recognizes completion of the shifting operation and retracts the shifting arms 208.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A shift tool, comprising:

a shifting system comprising a shifter arm;

sensors configured to generate measurement values when the shifting system is moved;

an artificial neural network trained to identify engagement of the shifter arm with a shifting feature of a sliding sleeve based on the measurement values generated by the sensors; and a control circuit configured to:

extend the shifter arm at a first pressure for seeking engagement with the shifting feature of the sliding sleeve; and responsive to the artificial neural network recognizing engagement of the shifter arm with the shifting feature of the sliding sleeve, extend the shifter arm at a second pressure for shifting the sliding sleeve wherein the second pressure is greater than the first pressure.

2. The shift tool of claim 1, wherein the measurement values the sensors are configured to generate comprise a time series of force measurements applied to move the shifting system.

3. The shift tool of claim 1, wherein the measurement values the sensors are configured to generate comprise a time series of pressure measurements applied by the shifter arm to an interior of the sliding sleeve.

4. The shift tool of claim 1, wherein the measurement values the sensors are configured to generate comprise a time series of force measurements applied to move the shifting system and a time series of pressure measurements applied by the shifter arm to an interior of the sliding sleeve.

5. The shift tool of claim 1, wherein the measurement values the sensors are configured to generate comprise a distance the shifting system is moved, a speed at which the shifting system is moved, a force applied to move the shifting system, and a pressure applied by the shifter arm to an interior of the sliding sleeve.

6. The shift tool of claim 1, further comprising:

an anchoring system comprising anchoring arms configured to engage a casing or a tubing disposed in a well; and a linear actuator coupled to the anchoring system and the shifting system and configured to provide an axial force to push or pull the shifting system by extending or retracting a rod.

7. The shift tool of claim 5, wherein the measurement values the sensors are configured to generate comprise a pressure or force applied by the anchoring arms, a pressure applied by the shifter arm, a length the rod is extended, a velocity of the rod, a force applied to move the rod, and/or a temperature.

8. The shift tool of claim 1, further comprising a wireline, a tractor, a combination of a wireline and a tractor, a drill pipe, or a battery powered slickline configured to deploy the shift tool in a well to position the shift tool in a vicinity of the sliding sleeve.

9. A method for operating a shift tool, comprising:

positioning the shift tool within a well in a vicinity of a sliding sleeve, the shift tool comprising:

a shifting system comprising a shifter arm;

sensors;

an artificial neural network; and a control circuit;

initiating extension of the shifter arm at a first pressure and initiating movement of the shifting system via the control circuit to seek engagement with a shifting feature of the sliding sleeve;

generating measurement values with the sensors;

identifying engagement of the shifter arms with the shifting feature of the sliding sleeve with the artificial neural network based on the measurement values generated by the sensors; and initiating extension of the shifter arm at a second pressure via the control circuit for shifting the sliding sleeve in response to the artificial neural network identifying engagement of the shifter arms with the shifting feature of the sliding sleeve;

wherein the second pressure is greater than the first pressure.

10. The method of claim 9, wherein the measurement values generated by the sensors comprise a time series of force measurements applied to move the shifting system.

11. The method of claim 9, wherein the measurement values generated by the sensors comprise a time series of pressure measurements applied by the shifter arm to an interior of the sliding sleeve.

12. The method of claim 9, wherein the measurement values generated by the sensors comprise a time series of force measurements applied to move the shifting system and a time series of pressure measurements applied by the shifter arm to an interior of the sliding sleeve.

13. The method of claim 9, wherein the measurement values generated by the sensors comprise a distance the shifting system is moved, a speed at which the shifting system is moved, a force applied to move the shifting system, and a pressure applied by the shifter arm to an interior of the sliding sleeve.

14. The method of claim 9, wherein positioning the shift tool within the well in the vicinity of the sliding sleeve is carried out via a wireline, a tractor, a combination of a wireline and a tractor, a drill pipe, or a battery powered slickline.

* * * * *